United States Patent [19]

Kepplinger

[11] Patent Number: 4,725,308

[45] Date of Patent: Feb. 16, 1988

[54] PROCESS FOR PRODUCING MOLTEN PIG IRON OR STEEL PRE-PRODUCTS

[75] Inventor: Werner Kepplinger, Linz, Austria

[73] Assignees: Voest-Alpine Atkiengesellschaft, Linz, Austria; Korf Engineering GmbH, Dusseldorf, Fed. Rep. of Germany

[21] Appl. No.: 876,305

[22] Filed: Jun. 18, 1986

Related U.S. Application Data

[63] Continuation of Ser. No. 634,590, Jul. 25, 1984, abandoned.

[30] Foreign Application Priority Data

Aug. 18, 1983 [AT] Austria ..... 2953/83

[51] Int. Cl.[4] ..... C21B 11/08

[52] U.S. Cl. ..... 75/26; 75/38; 75/40; 75/43

[58] Field of Search ..... 75/26, 38, 40, 43

[56] References Cited

U.S. PATENT DOCUMENTS

| | | | |
|---|---|---|---|
| 3,948,645 | 4/1976 | Elvander et al. | 75/26 |
| 4,317,677 | 3/1982 | Weber et al. | 75/38 |
| 4,504,043 | 3/1985 | Yamaoka et al. | 75/38 |

FOREIGN PATENT DOCUMENTS 63924 11/1982 European Pat. Off. .

*Primary Examiner*—Melvyn J. Andrews
*Attorney, Agent, or Firm*—Brumbaugh, Graves, Donohue & Raymond

[57] ABSTRACT

There is disclosed a process for the production of molten pig iron or of steel pre-products from particulate ferrous material as well as for the production of reduction gas in a meltdown gasifier. A fluidized-bed zone is formed by coke particles upon the addition of coal and by blowing in oxygen-containing gas by nozzle pipes penetrating the wall of the meltdown gasifier. The ferrous material to be reduced is introduced into the fluidized bed. In order to be able to produce molten pig iron and liquid steel pre-products in a direct reduction process with a lower sulfur content than has hitherto been the case, without having to make any particular demands on the sulfur content of the coal used, the ferrous material to be reduced is supplied closely above the blow-in gas nozzle plane producing the fluidized bed. An arrangement for carrying out the process includes a meltdown gasifier in which charging pipes penetrating its wall are provided in the region of the fluidized-bed zone closely above the plane formed by the nozzle pipes. The ferrous material to be melted as well as the dusts separated from the reduction gas and, if desired, fluxes containing calcium oxide, magnesium oxide, calcium carbonate and/or magnesium carbonate are introduced therethrough.

6 Claims, 1 Drawing Figure

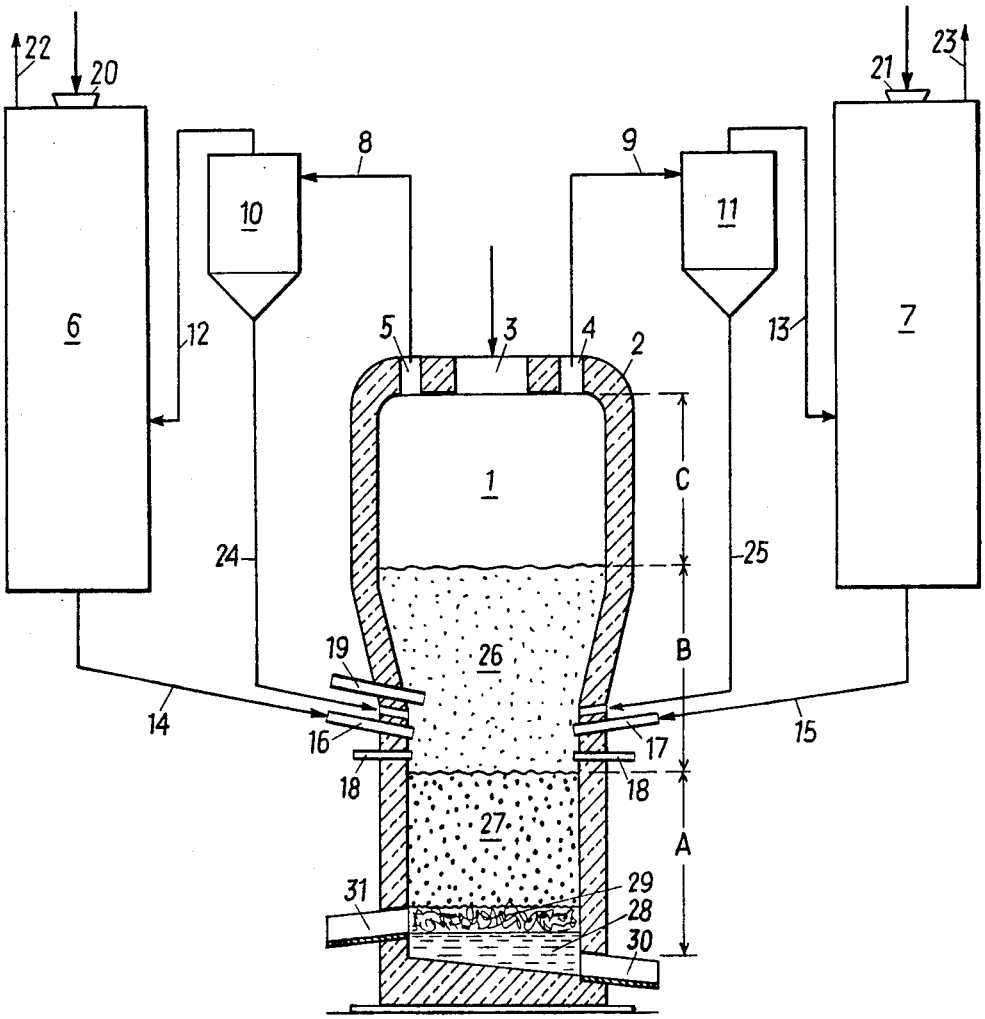
22
20
21
23
8
9
10
11
6
7
12
13
5
3
4
2
1
C
24
25
26
B
19
14
15
16
17
18
18
27
A
31
29
28
30

PROCESS FOR PRODUCING MOLTEN PIG IRON OR STEEL PRE-PRODUCTS

This application is a continuation of application Ser. No. 634,590, filed on July 25, 1984 now abandoned.

BACKGROUND OF THE INVENTION

The invention relates to a process for the production of molten pig iron or of steel pre-products from particulate ferrous material, in particular pre-reduced iron sponge, as well as for the production of reduction gas in a meltdown gasifier, wherein a fluidized-bed zone is formed by coke particles upon the addition of coal and by blowing in oxygen-containing gas by means of nozzle pipes penetrating the wall of the meltdown gasifier, into which the ferrous material to be reduced is introduced, as well as to an arrangement for carrying out the process.

A process of this kind is described in U.S. Pat. No. 4,317,677, wherein the oxygen-containing gas or pure oxygen is blown in above the metal sump formed or above the slag layer covering the same, through a ring of nozzle pipes penetrating the wall of the meltdown gasifier. In this manner, a fluidized bed of coke particles with a high-temperature zone in the lower region is produced. The particulate ferrous material, in particular pre-reduced iron sponge, and the lumpy coal are supplied from top through charging openings in the hood of the meltdown gasifier. The falling particles are braked in the fluidized bed and the ferrous particles are reduced and melted in falling through the coke fluidized-bed. The melted metal covered by slag, collects on the bottom of the melt-down gasifier. Metal and slag are drawn off through separate tap openings.

With the known process, difficulties may aries if coals are used having an elevated sulfur content. Usually, the sulfur content of metallurgically usable coals amounts to 0.7 to 1.2%, but sulfur contents of up to 2% may also occur. Therefore, with processes in which, by degassing such a coal, reduction gas is produced, which is used for pre-reducing in a combined pre-reduction - meltdown gasifying plant, it may happen that the reduction gas has considerable sulfur content. About one third of the sulfur contained in the coal is found in the reduction gas and is bound to iron as FeS in a very great portion during pre-reduction in a reduction shaft.

In common metallurgy, metallurgical coke has a sulfur content of from 0.7 to 0.6%. With a blast furnace process, however, this sulfur largely remains in the slag and will not provoke an intensive sulfurization of the pig iron. However, if pig iron is produced on the basis of a direct coal reduction process, as is the case with the initially mentioned process, considerably higher sulfur contents will occur than with the blast furnace metallurgy.

SUMMARY OF THE INVENTION

The invention aims at avoiding the difficulties and disadvantages described above and has as its object the production of molten pig iron and liquid steel pre-products in a direct reduction process with a lower sulfur content than has hitherto been the case. Advantageously, the process is destined, in particular, for combined pre-reduction - meltdown gasifying plants in which one or several reduction shafts cooperate with a meltdown gasifier, provided that no particular demands need be made on the sulfur content of the coal to be used.

These objects are achieved with a method of the initially defined kind in that the ferrous material to be reduced is supplied closely above the blow-in gas nozzle plane producing the fluidized bed.

According to a preferred embodiment of the invention, the particulate ferrous material is supplied through charging pipes penetrating the wall of the meltdown gasifier and entering into the fluidized bed.

This measure is based on the knowledge that in the fluidized bed a substantially lower sulfur content is present than in the reduction gas present in the upper part of the meltdown gasifier, which is called the killing zone. If the ferrous material to be charged does not come into contact with the sulfur-rich gas in the killing zone, the molten iron is considerably lower in sulfur than if the ferrous material falls through the killing zone from charging openings provided in the hood, as in known arrangements.

A further preferred embodiment consists in that the reduction gas formed at the reaction is conducted through one or several cyclones to separate dustlike components, the dustlike particles separated being returned into the meltdown gasifier through charging pipes pentrating the wall of the meltdown gasifier and entering at the height of the fluidized bed.

This measure is based on the knowledge that the sulfur mainly is contained in the dusts carried away with the reduction gas, i.e. predominantly as CaS. If the sulfurcontaining dusts, together with the reduction gas for the pre-reduction, are conducted into a pre-reduction shaft arranged ahead of the meltdown gasifier, the stock contained in the reduction shaft in the form of pellets, lumpy ore, etc., has a filtering effect in that the sulfur-containing dusts are held back and are quantitatively taken up by the piling. They will then return into the meltdown gasifier with the pre-reduced material, resulting in a larger portion of sulfur reaching the molten metal. If, however, the dusts are separated and directly supplied to the fluidized bed, as suggested by the invention, this disadvantageous consequence no longer occurs.

According to another embodiment of the invention, a desulfurization effect can be achieved also by subjecting the reduction gas formed at the reaction to desulfurization before being used as a reductant in a pre-reduction process preceding the meltdown gasification. Such a desulfurization can be effected by passing the reduction gas through a desulfurization column containing a lumpy desulfurizing agent, such as lump lime.

A further advantageous embodiment consists in that lime- and/or magnesium-containing fluxes, such as dolomite, magnesite, calcium oxide, magnesium oxide or mixtures thereof, are blown in in fine-particle form through further charging pipes entering in the region of the fluidized bed. This embodiment, which also aims at a reduction of the sulfur content in the molten iron, is based on the fact that, with the simultaneous presence of lime and directly reduced iron, sulfur preferably binds with lime in a temperature range of above 900° C. The lime, dolomite or magnesium dusts may be blown in either simultaneously with the oxygen-containing carrier gas or by means of separate charging pipes. Advantageously, these fluxes are used in their oxidic forms, because in this case no deacidification need be carried out.

According to a further embodiment of the invention, a solid, i.e., static or fixed, bed zone is provided below the fluidized bed, which, advantageously, is maintained at a higher temperature than the melting temperature of the ferrous material. This embodiment has the advantage that a re-oxidation of the reduced and melted material is counteracted.

The invention, moreover, covers an arrangement comprising a refractorily lines meltdown gasifier including openings for the addition of coal or other solid carbon-containing fuels, ferrous material and for the discharge of the reduction gas formed, further openings for the slag and melt tap, a lower section being provided to collect the melted metal and the liquid slag, a central section being provided to accommodate a fluidized bed of coke, and following upon the latter an upper section serving as a killing space, as well as nozzle pipes penetrating the wall of the meltdown gasifier in the lower region of the central section to inject oxygen-containing carrier gas and, if necessary, fuels for the formation of the fluidized bed. The arrangement is characterized in that closely above the plane formed by the nozzle pipes, charging pipes penetrating the wall of the meltdown gasifier in the region of the fluidized-bed zone are provided to introduce the ferrous material to be melted as well as to introduce dusts separated from the reduction gas and, if desired, fluxes containing calcium oxide, magnesium oxide, calcium carbonate and/or magnesium carbonate.

BRIEF DESCRIPTION OF THE DRAWING

The process according to the invention and the arrangement for carrying out the same are schematically illustrated in the single FIGURE of the accompanying drawing.

DETAILED DESCRIPTION OF THE INVENTION

A refractorily lined meltdown gasifier 1 comprises a lower section A, a central section B and an upper section C widened in terms of diameter. The lower section A is destined to collect molten metal, slag and a superposed solid bed of coke particles, the central section B is destined to form the fluidized bed of coke particles and an oxygen-containing carrier gas, and the upper section C serves as a killing space for the reduction gas forming.

In the hood 2 of the meltdown gasifier 1, an opening 3 is provided for the charging of coal particles. Furthermore, openings 4 and 5 are provided in the hood to discharge the reduction gas formed. The meltdown gasifier illustrated in the schematic drawing cooperates with two pre-reduction shafts 6 and 7 to which it is connected by ducts 8, 9, respectively. A cyclone 10, 11 is each disposed in these connection ducts 8, 9 for the separation of dust, the dedusted gas being introduced into the lower parts of the pre-reduction shafts through ducts 12, 13.

From the bottom of the pre-reduction shafts 6, 7, ducts 14, 15 lead to the central part B of the meltdown gasifier, penetrating the wall of the meltdown gasifier at this site and entering into the interior of the meltdown gasifier as charging pipes 16, 17 for the pre-reduced ferrous material. Closely below these charging pipes, a ring of nozzle pipes 18 penetrating the wall of the meltdown gasifier is provided to blow in oxygen-containing carrier gas. Furthermore, additional charging pipes 19 for calciferous fluxes are provided in the region of section B. The pre-reduction shafts, in the upper parts, comprise charging openings 20, 21 for the supply of iron ore and gas exhausts 22, 23. From the bottom parts of the cyclones 10, 11, ducts 24, 25 return to the meltdown gasifier. They enter into the section B of the meltdown gasifier by sockets penetrating the wall of the meltdown gasifier.

The plant functions in the following manner:

Coal and coke particles are continuously introduced into the meltdown gasifier through the opening 3, falling through downwardly. By injecting oxygen-containing gas through the ring of nozzles 18, a fluidized bed 26 or a fluidized-bed zone of coke particles in section B and a solid bed 27 of coke particles in section A are formed in dependence on the gas pressure applied and the sizes of the particles charged. The pre-reduction shafts are continuously supplied with iron ore in lumpy form through the upper openings 20, 21, and the material, which has been pre-reduced in the pre-reduction shafts 6, 7 by the influence of the reduction gas, in particular iron sponge, is directly introduced into the fluidized-bed zone 26 through the ducts 14, 15 and through the charging pipes 16, 17.

The reduction gas forming during the reduction is dedusted in the cyclones 10, 11 after having passed the killing space C, from openings 4 and 5. As already mentioned, the deducted gas is introduced into the pre-reduction shafts 6, 7. The separated dust is returned into the fluidized-bed zone 26 from the bottoms of the cyclones through the ducts 24, 25.

The molten iron formed at the reduction collects in the bottom part of the meltdown gasifier and forms a sump 28 covered by a slag layer 29. Metal and slag are conducted away through tap openings 30, 31.

What I claim is:

1. A process for producing molten pig iron or steel pre-products of low sulfur content from particulate ferrous material and reduction gas in a meltdown gasifier, comprising the steps of:

providing a meltdown gasifier having an upper coal charging and reduction gas discharging end and a lower molten metal and slag collection ends;

introducing sulfur-containing coal into said gasifier at said coal charging end, blowing oxygen-containing gas into the coal along a plane at a predetermined level in said gasifier intermediate the ends thereof to form therein a fluidized bed of coke particles of relatively low sulfur content with respect to the coal, above said plane with the production of reduction gas of higher sulfur content than said fluidized bed thereabove in said gas discharging end, and, introducing particulate ferrous materials including sponge iron into said fluidized bed at a level closely above the plane at which said oxygen-containing gas is blown into said gasifier, the resultant reaction in said gasifier producing said reduction gas and said molten pig iron or steel pre-products of low sulfur content regardless of the sulfur content of the coal introduced into the gasifier.

2. The process of claim 1 wherein the reduction gas produced in the gasifier contains dustlike particles, and further comprising the steps of, separating the dustlike particles from reduction gas obtained from the gasifier and feeding said particles back into said gasifier at the level of said fluidized bed.

3. The process of claim 1 wherein the reduction gas produced in the gasifier contains sulfur, and further comprising the step of desulfurizing the reduction gas leaving the gasifier.

4. The process of claim 2 or 3 further comprising the step of pre-reducing iron ore with the reduction gas produced in the gasifier to provide said particulate ferrous materials.

5. The process of claim 3, wherein the step of desulfurizing the reduction gas comprises introducing into said fluidized bed, in fine-particle form, at least one flux selected from the group consisting of dolomite, magnesite, calcium oxide, magnesium oxide, and mixtures thereof.

6. The process of claim 1, wherein a static bed zone is created below said fluidized bed and wherein the temperature of said static bed zone is maintained higher than the melting temperature of said ferrous materials.

* * * * *

UNITED STATES PATENT AND TRADEMARK OFFICE

CERTIFICATE OF CORRECTION

PATENT NO. : 4,725,308

DATED : Feb. 16, 1988

INVENTOR(S) : Werner Kepplinger

It is certified that error appears in the above-identified patent and that said Letters Patent is hereby corrected as shown below:

First page, Item 56, add to the list of U. S. PATENT DOCUMENTS:

| | | |
|---|---|---|
| --2,560,470 | 7/1951 | Ogorzaly |
| 2,894,831 | 7/1959 | Old et al. |
| 3,205,065 | 9/1965 | Mayer et al. |

and add to the list of FOREIGN PATENT DOCUMENTS:

| | | |
|---|---|---|
| --2,521,038 | 5/1975 | Fed. Rep. of Germany--. |

Col. 3, line 9, "lines" should read --lined--.

Col. 4, line 42, "ends" should read --end--.

Signed and Sealed this

Twenty-third Day of August, 1988

*Attest:*

*Attesting Officer*

DONALD J. QUIGG

*Commissioner of Patents and Trademarks*